United States Patent [19]

Tax et al.

[11] Patent Number: 4,603,783

[45] Date of Patent: Aug. 5, 1986

[54] DEVICE ON HOISTING MACHINERY FOR AUTOMATIC CONTROL OF THE MOVEMENT OF THE LOAD CARRIER

[75] Inventors: Hans Tax, Munich; Herbert Kürz, Putzbrunn, both of Fed. Rep. of Germany

[73] Assignee: BETAX Gesellschaft für Beratung und Entwicklung technischer Anlagen mbH, Munich, Fed. Rep. of Germany

[21] Appl. No.: 800,895

[22] Filed: Nov. 21, 1985

Related U.S. Application Data

[63] Continuation of Ser. No. 756,557, Jul. 17, 1985, abandoned, which is a continuation of Ser. No. 477,223, Mar. 21, 1983, abandoned.

[30] Foreign Application Priority Data

Mar. 22, 1982 [DE] Fed. Rep. of Germany ..... 3210450

[51] Int. Cl.[4] ..... B66C 19/00

[52] U.S. Cl. ..... 212/132; 212/147

[58] Field of Search ..... 212/86, 124, 131, 132, 212/141, 146, 147, 161, 205; 318/384, 393, 396, 397; 244/137 A

[56] References Cited

U.S. PATENT DOCUMENTS 3,517,830 6/1970 Virkkala ..... 212/146

3,921,818 11/1975 Yamagishi ..... 212/132

FOREIGN PATENT DOCUMENTS 1172413 6/1964 Fed. Rep. of Germany .

1209266 1/1966 Fed. Rep. of Germany .

3005461 9/1981 Fed. Rep. of Germany .

2108726 4/1972 France .

2399378 3/1979 France .

22250 3/1978 Japan ..... 212/147

111957 9/1978 Japan ..... 212/147

1132967 11/1968 United Kingdom .

*Primary Examiner*—Trygve M. Blix

*Assistant Examiner*—Stephen P. Avila

*Attorney, Agent, or Firm*—Toren, McGeady, Stanger, Goldberg & Kiel

[57] ABSTRACT

In a device on hoisting machinery for automatically controlling the movement of a load carrier and for steadying the pendulum-type motion of a load suspended from the load carrier, a signal transmitter is provided for controlling the movement of the load carrier traction motor by means of a selected substantially cosine-shaped load carrier acceleration signal ($b_K$). In such control a reduction is obtained of the acceleration time interval and braking time interval (T), respectively, at a selected maximum pulling force of the load carrier traction motor, and it is possible to keep the pulling force constant. The load acceleration ($b_L$) follows a cosine curve.

13 Claims, 7 Drawing Figures

P (9,81·N)
522
400
200
0
$P_0$
t (s)
0
5 T
10 s (m)
10
5
0
$s_0$
$s_K$
$s_L$
t (s)

v (m/s)
2
1
0
$v_K$
$v_L$
$v_N$
t (s)

b (m/s²)
1
0
$b_K(0)$
$b_K$
$b_L$
t (s)
t = $T_0$ = T = 5,47 s

FIG. 2A
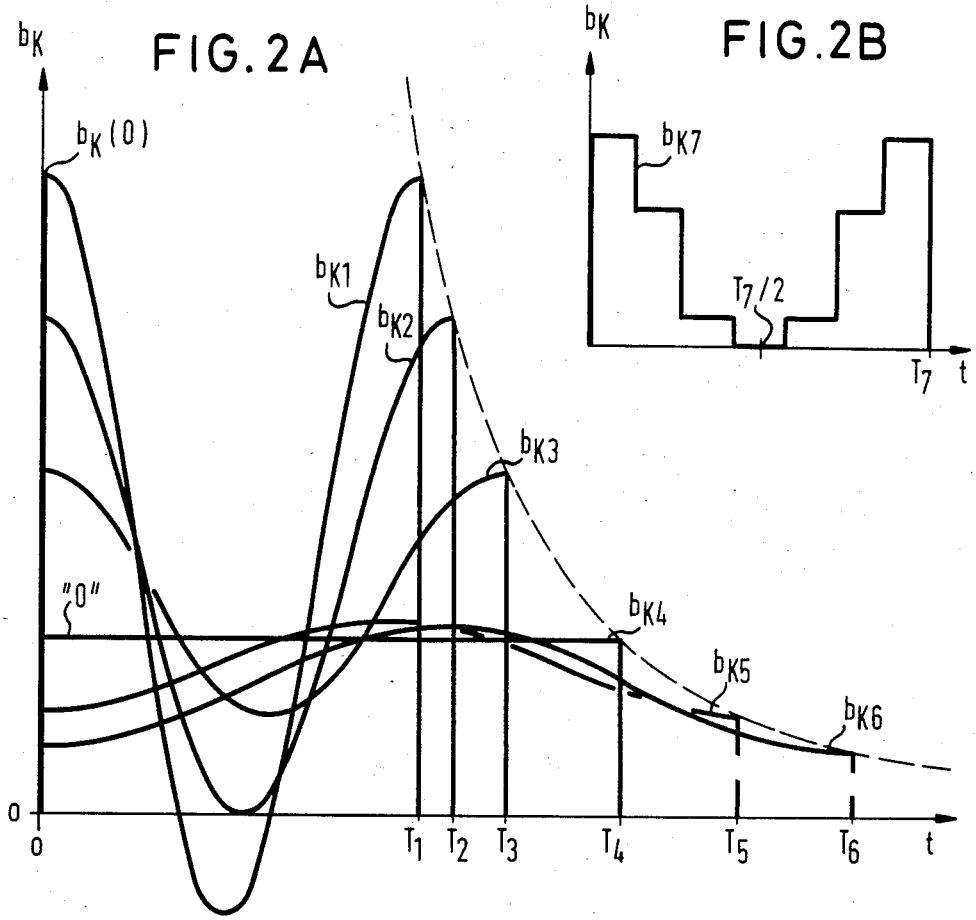
FIG. 2B
FIG. 3
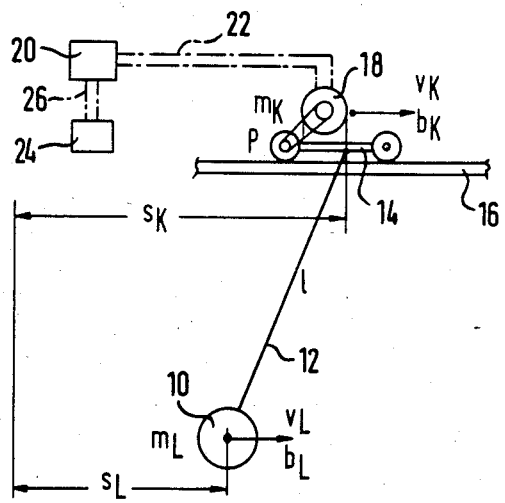

DEVICE ON HOISTING MACHINERY FOR AUTOMATIC CONTROL OF THE MOVEMENT OF THE LOAD CARRIER

This is a continuation of application Ser. No. 756,557 now abandoned, filed July 17, 1985 which was a continuation of Ser. No. 477,223 filed Mar. 21, 1983, now abandoned.

SUMMARY OF THE INVENTION

The present invention is directed to a device on hoisting machinery for automatically controlling the movement of the load carrier and for steadying the pendulum-type motion of the load suspended from the carrier during the time interval associated with accelerating or braking the load carrier The device includes a signal transmitter for sending signals for controlling the movement of a load carrier traction motor, particularly for a selected load carrier acceleration, where the signal progression curve corresponds to a load carrier acceleration progression symmetrical to the center of the interval with maximum acceleration values at the start and finish of the interval and with smaller and possibly vanishing minimum acceleration values. between the maximum values.

A device of this type is disclosed in West German Auslegeschrift No. 11 72 413 in which the control signal for a selected load carrier acceleration is formed in two acceleration stages, that is, in an initial period with a constant acceleration (maximum acceleration value), a terminating period with the same constant acceleration, and an intermediate period with vanishing or diminishing acceleration located between the initial and terminating period. The duration of the intermediate period is fixed exactly so that the amplitude of the pendulum swing of the load and the pendulum velocity at the beginning and end of the period are the same, although with reversed or opposite signs of the direction of movement. Accordingly, a symmetrical course of movement, with respect to the pendulum-type motion of the load on the load carrier, is obtained and the same movement is adjusted at the end of the interval as at the beginning. If the load was suspended steadily from the load carrier before acceleration or braking, then it will be suspended steadily after the ensuing acceleration of braking. Accordingly, "steadying the pendulum-type motion" in this context is understood to mean that the pendulum-type motion which necessarily occurs during the positive or negative acceleration of the load is eliminated at the end of the acceleration or braking time interval, respectively. With this single-stage acceleration at both the beginning and end of the time interval, a reduction of the acceleration or braking time interval is obtained relative to an acceleration which is constant during such interval. Based on the disclosure in the West German Auslegeschrift No. 11 72 413, by a corresponding increase in the maximum acceleration value, the length of the time interval can be shortened in the limiting case up to half the period of the pendulum-type motion formed by the suspended load when the load carrier is stationary unless the traction force to be applied by the motor during the time interval exceeds the maximum pulling force of the motor.

In contrast, the primary object of the present invention is to provide a further reduction in the acceleration or braking time interval at a selected maximum traction motor pulling force.

In accordance with the present invention, the signal progression produced by the signal producer corresponds to a load carrier acceleration monotonically decreasing or increasing continuously in each instance or, at least, in two stages between the maximum values of acceleration and the minimum values of acceleration possibly with a reversed sign.

In accordance with the present invention, the knowledge is used that the portion of the pulling or traction force to be applied by the load carrier traction motor, which portion is due to the acceleration of the load, increases continuously from zero at the beginning of the interval to a maximum value in the middle of the interval and then decreases symmetrically. In a constant initial acceleration based on the known solution, the traction force to be applied increased continuously, then decreases more or less to a great extent at the end of the initial period and then increases again until the middle of the interval. In the present invention, however, since the portion of the total traction force due to the load carrier acceleration decreases continuously or in stages, no traction force peaks occur between the start and finish of the interval. In the situation where the mass of the load is substantially greater than that of the load carrier, the minimum value of acceleration in the middle of the interval can also receive a reversed sign compared to the maximum value of acceleration to avoid a traction force peak in this region. Because of the leveling off of the traction force, a higher initial acceleration value (=maximum acceleration value) can be selected. Further, acceleration or braking work respectively, is also carried out at a later time so that, as a whole, a noticeable shortening of the acceleration or braking time interval results at a selected maximum traction force. The time interval can also be further shortened under the previously indicating limiting case (half period).

It has proved to be particularly advantageous if the signal progression corresponds, with constant basic acceleration, to a substantially cosine-shaped load acceleration progression or curve of one or more periods. Such a signal progression can be quickly and easily determined. Short interval lengths result from particularly short pendulum lengths, and to avoid any maximum acceleration values which are too high in such a situation, the acceleration or braking is carried out in several successive periods of cosine shape.

For a predetermined pendulum length and a predetermined difference in speed before and after acceleration or braking, a family of cosine curves for the acceleration progression are available with varying periods of length, amplitude and basic acceleration from which the best can be selected corresponding to the respective conditions. In a selected relationship of load mass and load carrier mass, the signal progression preferably corresponds to a load carrier acceleration fixed in such a way that the traction force to be provided by the load carrier traction motor during the time interval for accelerating the load carrier and the load is substantially constant. For optimum results a traction motor designed for this pulling force is utilized. Where there are relatively slight driving resistances, there is the possibility of a simple motor control, that is, control based on a constant motor torque.

In the situation where there are different load masses at substantially constant pendulum lengths, it is suggested that the signal progression produced by the signal transmitter, in each instance, be the same and fixed in such a way that the traction force to be applied for the maximum load mass to occur is substantially constant. Only a single signal progression is to be fixed without the danger that the maximum traction force will be exceeded for any one of the load masses utilized.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 1A—acceleration,

FIG. 1B—velocity,

FIG. 1C—distance, and

FIG. 1D—traction force;

FIG. 2A is a graphic showing of a family of cosine-shaped load carrier acceleration curves;

FIG. 2B is a graphic representation of a stepped load carrier acceleration of curves; and FIG. 3 is a very simplified schematic illustration of a load carrier with a suspended load and a controlled traction motor.

DETAIL DESCRIPTION OF THE INVENTION

Figures 1A, 1B, 1C, 1D:
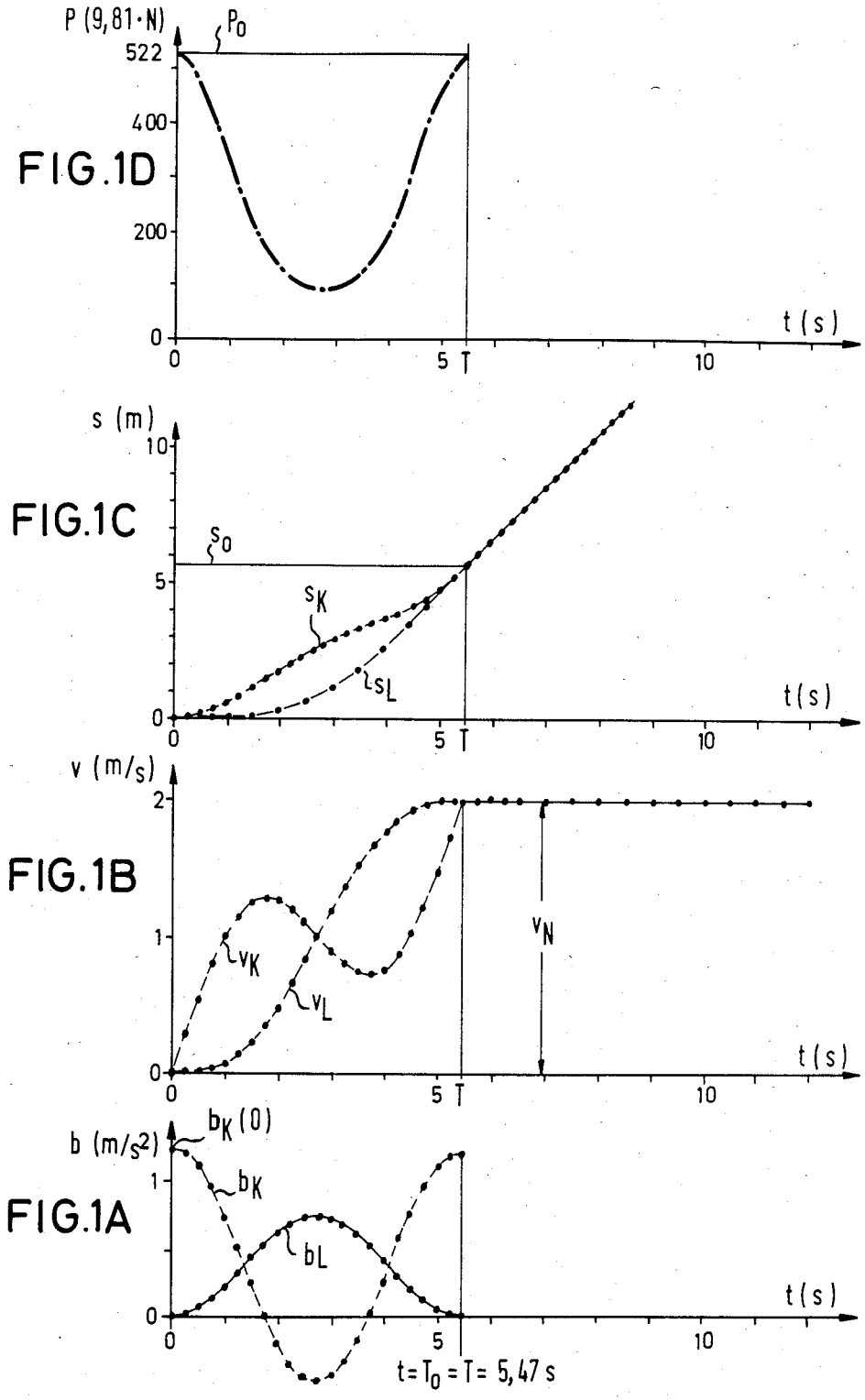
FIGS. 1A to 1D are graphic representations of the movement parameters at constant pulling force where the figures represent as follows.

In FIGS. 1 and 2 the time is indicated by t and the acceleration time interval by T and $T_1$ to $T_6$, respectively, and $b_K$ is the load carrier acceleration. In the following example the load carrier is a trolley or trolley carriage and is represented by the reference character K. It should be understood, that other load carriers could also be used, such as a boom. The reference character L indicates the load suspended from the trolley by a cable or the like. In FIG. 1A, the parameter identified as $b_L$ the load acceleration.

FIG. 1B displays the velocity $v_K$ and $v_L$ of the trolley and load during the interval T. FIG. 1C indicates the horizontal distance $s_K$ and $s_L$ of the trolley and the load. In FIG. 1D the time progression of the traction force P applied by the traveling motor of the trolley for the acceleration of the trolley and the load can be noted.

It can be shown that a progression of the load acceleration (or load deceleration) following the equation $$b_L = C\cdot(1-\cos\beta t)$$

is obtained (C is a constant) where the trolley and the load at t=0 as well as at the $$t = T = n\cdot T_o = n\cdot 2\pi/\beta$$

are located perpendicularly above one another when the following relationship applies to the trolley acceleration $b_K$:

$$b_K = \frac{v_N}{n\cdot T_o}\left(1+\left(\frac{1}{g}-\frac{T_o^2}{4\pi^2}\right)\frac{4\pi^2}{T_o^2}\cdot\cos\left(\frac{2\pi t}{T_o}\right)\right) \quad \text{(A)}$$

In this equation, $v_N$ is the difference in velocity before and after acceleration or braking, respectively; l represents the pendulum length, g is the acceleration due to gravity, and n represents a whole number with values 1, 2, 3 . . . etc. $T_o$ is the period (natural oscillation time of the pendulum) to which the following relationship applies:

$$T_o = \sqrt[3]{\frac{v_N}{n\cdot b_K(0)}\cdot\frac{1}{g}\cdot 4\pi^2} \quad \text{(B)}$$

In this equation, the value of the trolley acceleration at t=0 is represented by $b_K$ (zero) which value is equal to the maximum acceleration value.

The trolley velocity can be determined as follows, by integration, from the equation for trolley acceleration $b_K$:

$$v_k = \frac{v_N}{n\cdot T_o}\left(t+\left(\frac{1}{g}-\frac{T_o^2}{4\pi^2}\right)\frac{2\pi}{T_o}\cdot\sin\left(\frac{2\pi t}{T_o}\right)\right) \quad \text{(C)}$$

Another integration produces the following relation for the trolley path:

$$s_K = \frac{v_N}{n\cdot T_o}\left(\tfrac{1}{2}t^2+\left(\frac{1}{g}-\frac{T_o^2}{4\pi^2}\right)\cdot\left(1-\left(\cos\frac{2\pi t}{T_o}\right)\right)\right) \quad \text{(D)}$$

To impress a selected velocity change on a load without the load continuing to move in a pendulum-type motion it is necessary only to control the movement of the trolley by selecting one of the three movement parameters $b_K$, $v_K$, or $s_K$ (equation(A) or (C) or (D)) while allowing for the period $T_o$ (equation(B)).

These parameters are shown in the schematic representation afforded in FIG. 3. A load 10 is suspended by a carrying cable 12 of a length l from a movable trolley 14. The trolley 14 travels over a horizontal rail 16 and is driven by an electric traction motor 18. Traction motor 18 is driven by a controllable energy supply 20 connected by lines 22, shown as dashed lines, to the trolley. The energy supply 20 is controlled by a signal transmitter 24 and is connected to it by control lines 26 shown as dashed lines. The signal transmitter 24 supplies the trolley acceleration signal $b_K$ shown in FIG. 1A and, in turn, the energy supply 20 provides the traction motor 18 with electrical energy so that the motor accelerates the movable trolley. In such a traction motor control (such as in servomotors) an actual position value is selected and this value is compared with an index position or rated value or with an index velocity value after a time differentiation or, as in the present case, with an index acceleration value after a second time differentiation. Therefore, the movement control of the movable trolley can be based on the velocity progression $v_K$ according to FIG. 1B or on the distance traveled $s_K$ according to FIG. 1C. Since the pendulum movement is independent of the load mass $m_1$ in a first approximation, the same index movement value ($b_K$ or $v_K$ or $s_K$) can, as a rule, be given for the different load masses which occur. Moreover, it is also possible for known load masses to control the traction force P (that is, the total force minus the forces to be applied for overcoming the driving resistances) of the traction motor 18 according to the assigned curve in FIG. 1D, which traction force is applied for accelerating the trolley and the load.

FIG. 2A illustrates six acceleration curves $b_{K1}$ to $b_{K6}$ from the family of curves assigned to a determined pendulum length l and to a determined velocity difference $v_n$ with n=1. Period $T_o$ follows from initial acceleration $b_K(0)$ according to equation (B) as does the progression of the trolley acceleration $b_K$ according to equation (A). It can be seen that period $T_o$, and, accordingly, time interval $T=n\cdot T_o$ can be varied within a wide range (n=1 in FIG. 2). The acceleration curve with the shortest time interval $T_1$ is designated by $b_{K1}$, the next shortest time interval $T_2$ is designated as $b_{K2}$ and so on to $b_{K6}$. A special case is curve $b_{K4}$ with a horizontal progression which results when $$T = T_o = 2 \cdot \pi \cdot \sqrt{\frac{l}{g}} .$$

Curves $b_{K5}$ and $b_{K6}$ with a negative factor in front of the cosine function in equation (A) are eliminated in the normal case, since they lead to an undesired peak value of the traction force applied by the motor 18 in the middle of the period. The following relationship applies for the acceleration traction force P to be applied by the driving motor:

$$P=m_L\cdot b_L+m_K\cdot b_K$$

As shown in FIG. 1A, the load acceleration starting from zero increases to a maximum value at the midpoint of the period which, after multiplying by the load mass $m_L$ which generally exceeds the trolley mass $m_K$, leads to a correspondingly high traction force in the middle of the period. To avoid a traction force peak in the middle of the period, the portion of the traction force contributed by the trolley is reduced by the corresponding selection of trolley acceleration $b_K$ and, in the example shown, it is even provided with a reversed sign With a given mass relation $m_K$:$m_L$ it is possible to select exactly the trolley acceleration curve from the family of curves that provides a constant pulling force P during the entire period. It can be shown that the constant pulling force designated by $P_o$ has the following value:

$$P_0 = \frac{v_N}{2\pi n} \sqrt{\frac{(m_L + m_K)^3}{m_K} \cdot \frac{g}{l}} \quad \text{(E)}$$

the following applies to the initial period point:

$$P_O=m_K\cdot b_K(0),$$

from which the initial acceleration $b_K(0)$ follows which is to be inserted into equations (A) and (B) from which the curve shape $b_K$ in FIG. 1A derives. FIGS. 1A to 1B are based on the following values:

l=24.85 m,
$b_K(0)=1.22$ m/sec$^2$,
$m_L=1000$ kg,
$m_K=427$ kg,
$v_N=2^m$/sec,
n=1

An oscillation period $T_o$ of 5.47 seconds is obtained, the constant traction force $P_O$ amounts to 522·9.81N. If a traction motor with a maximum pulling force is chosen for the given load mass of 1000 kg then the traction motor has a pulling or traction force of 522·9.81.N plus the force to be applied for overcoming the driving resistances. The traction motor can then drive over the total acceleration or braking distance with substantially the same drive torque.

If, at the same pendulum length l and trolley mass $m_K$, a smaller load mass $m_L$ is suspended, then the acceleration curve $b_K$ which provides the constant traction force $P_O$ can be selected from the assigned curve family for this new mass relation, and, in turn, this results in a particularly uniform running of the trolley.

For the sake of simplicity, however, the acceleration curve $b_K$ can be retained unchanged in most cases, with the result that the traction force decreases towards the middle of the period. This is shown in FIG. 1D with a broken line in the case where the load mass $m_K$ only amounts to approximately 410 kg.

With a decreasing pendulum length l, the period $T_o$ also decreases in accordance with equation (B), with the amplitude of the trolley acceleration $b_K$ increasing accordingly. Furthermore, to avoid exceeding the maximum traction force, it is advisable to carry out acceleration or braking during at least two successive periods where n=2 is then to be inserted in equations (A) and (B). The total acceleration or deceleration time T is n times, that is, twice the period $T_o$ according to equation (B) with n=2 or approximately 1.586 times period $T_o$ according to equation (B) with n=1.

By way of approximation, the control of the traction motor 18 can be based on a stepped progression in place of a continuous progression of the trolley acceleration $b_K$ as is illustrated in FIG. 2B by means of the stepped curve $b_{K7}$. Three separate stages are shown to the left and right of the interval center $T_7/2$ and these stages decrease in the same manner toward the interval center and they are symmetrical relative to the center.

As set forth above, with the aid of FIGS. 1A to 1D, only the starting process was explained in which the load velocity was changed from value 0 to $v_N$, and it is clear that the braking process proceeds in the same manner so that the control is based only on the acceleration curve $b_K$ according to FIG. 1A with a reversed sign from the signal transmitter 24. To achieve a defined load unloading point, the braking process must be introduced at a distance $s_O$ from this point corresponding to the starting acceleration distance $s_O$ shown in FIG. 1C.

While specific embodiments of the invention have been shown and described in detail to illustrate the application of the inventive principles, it will be understood that the invention may be embodied otherwise without departing from such principles.

We claim:

1. Device for hoisting machinery for atuomatically controlling the movement of a load carrier and for steadying the pendulum-type motion of a load suspended from said load carrier which motion occurs during acceleration or braking of the load carrier during the corresponding acceleration time interval or braking time interval, comprising a load carrier traction motor, a signal transmitter for sending control signals for controlling the movement of said load carrier traction motor, a signal progression for controlling the traction motor corresponds to a load carrier acceleration progression ($b_K$) symmetrical to the center (T/2) of the interval with maximum acceleration values ($b_K(0)$) at the beginning and end of the interval and smaller minimum acceleration values between the values at the beginning and end of the interval, the signal progression produced by said signal transmitter (24) corresponds to a load carrier accelearion ($b_K$) monotonically decreasing or increasing between said maximum acceleration values ($b_K(0)$), and when the following relationship applies to load carrier acceleration ($b_K$):

$$b_K = \frac{v_N}{n \cdot T_o}\left(1 + \left(\frac{1}{g} - \frac{T_o^2}{4\pi^2}\right)\frac{4\pi^2}{T_o^2} \cdot \cos\left(\frac{2\pi t}{T_o}\right)\right)$$

where $V_N$ is the difference in velocity before and after acceleration or braking, l represents the pendulum length of the load, g is the acceleration due to gravity, and n represents a whole number, and $T_o$ is the period (natural oscillation time of the pendulum) to which the following relationship applies:

$$T_o = \sqrt[3]{\frac{v_N}{n \cdot b_K(0)} \cdot \frac{1}{g} \cdot 4\pi^2}\ .$$

2. Device, as set forth in claim 1, including continuously monotonically decreasing or increasing the load carrier acceleration between said maximum acceleration values.

3. Device, as set forth in claim 1, including monotonically decreasing or increasing the load carrier acceleration at least in two stages between said maximum acceleration values.

4. Device, as set forth in claim 1, wherein said signal progression with constant basic acceleration corresponds to a substantially cosine-shaped load carrier acceleration progression ($b_K$) of at least one period.

5. Device, as set forth in claim 4, wherein said signal progression corresponds to a load carrier acceleration ($b_K$) determined so that the traction force (P) applied by said traction motor during the time interval(T) for accelerating said load carrier (14) and the load (10) is substantially constant ($P_O$).

6. Device as set forth in claim 5, wherein at a substantially constant pendulum length (L) for variable load masses ($m_L$), the signal produced by said signal transmitter is for each load the same and is determined so that the traction force (P) applied at the maximum load mass ($m_L$) is substantially constant ($P_O$).

7. Method for automatically controlling the movement of a load carrier driven by an electrical traction motor on hoisting machinery and of steadying the pendulum-type motion of a load suspended from the load carrier during the time interval of acceleration or braking comprising the steps of selectively supplying electrical power to the traction motor for controlling the movement of the load carrier, basing the selective supply of electrical power on a signal progression corresponding to a load carrier acceleration progression symmetrical to the center of a time interval for acceleration or braking with maximum acceleration values at the beginning and end of the interval and smaller minimum acceleration values between the beginning and end of the interval, and providing the signal progression corresponding to a load carrier acceleration ($b_A$) monotonically decreasing or increasing between the acceleration maximum values, and when the following relationship applies to load carrier acceleration ($b_K$):

$$b_K = \frac{v_N}{n \cdot T_o}\left(1 + \left(\frac{1}{g} - \frac{T_o^2}{4\pi^2}\right)\frac{4\pi^2}{T_o^2} \cdot \cos\left(\frac{2\pi t}{T_o}\right)\right)$$

where $v_N$ is the difference in velocity before and after acceleration or braking, l represents the pendulum length of the load, g is the acceleration due to gravity, and n represents a whole number, and $T_o$ is the period (natural oscillation time of the pendulem) to which the following relationship applies:

$$T_o = \sqrt[3]{\frac{v_N}{n \cdot b_K(0)} \cdot \frac{1}{g} \cdot 4\pi^2}\ .$$

8. Method, as set forth in claim 7, comprising the step of providing vanishing minimum acceleration values between the maximum acceleration values.

9. Method, as set forth in claim 7, including the step of continuously monotonically increasing or decreasing the acceleration between the maximum values.

10. Method, as set forth in claim 7, including monotonically decreasing or increasing the acceleration in at least two stages between the maximum values.

11. Method, as set forth in claim 7, wherein the signal progression with constant basic acceleration corresponds to a substantially cosine-shaped load carrier acceleration progression of at least one period.

12. Method, as set forth in claim 11, providing the signal progression in correspondence to a load carrier acceleration ($b_K$) and fixing the traction force during the time interval (T) for accelerating the load carrier and the load at a substantially constant value.

13. Method, as set forth in claim 12, including the steps of maintaining the pendulum length constant for different load masses ($m_L$) and producing the signal progression so that the traction force applied at the maximum occurring load mass ($m_L$) is substantially constant.

* * * * *